United States Patent [19]

Habereder et al.

[11] 4,089,646

[45] May 16, 1978

[54] PAPER COATING DYES

[75] Inventors: Peter Habereder, Munich; Friedrich Bayerlein, Krailing, both of Germany

[73] Assignee: Diamalt Aktiengesellschaft, Munich, Germany

[21] Appl. No.: 665,316

[22] Filed: Mar. 9, 1976

[51] Int. Cl.[2] ..... D21H 1/46

[52] U.S. Cl. ..... 8/7; 428/535

[58] Field of Search ..... 8/7; 428/535; 536/114

[56] References Cited

U.S. PATENT DOCUMENTS

| | | | |
|---|---|---|---|
| 1,733,524 | 10/1929 | Bradner | 8/7 |
| 2,477,544 | 7/1949 | Moe | 536/114 |
| 2,502,783 | 4/1950 | Erickson | 428/535 |
| 2,599,771 | 6/1952 | Moe | 536/114 |
| 3,573,236 | 3/1971 | Barlow | 428/535 |

OTHER PUBLICATIONS

Rao et al., Industrial Guins, 1973, Academic Press, pp. 370, 371, 375, 379 & 380.

*Primary Examiner*—William E. Schulz
*Attorney, Agent, or Firm*—Haseltine, Lake & Waters

[57] ABSTRACT

A paper coating dye composition wherein synthetic binding agents partially or totally replace casein and also containing a water retention agent, is described.

2 Claims, No Drawings

PAPER COATING DYES

The present invention is related to paper coating dyes having the usual composition with the distinction that synthetic binding agents are totally or partially substituted for casein, and which also contain a water retention agent.

It is known to finish paper by applying a surface coating thereto i.e., to enchance its printability, its gloss and its degree of whiteness by coating the paper with a so-called paper coating dye. Paper coating dyes are substantially composed of white pigments, binding agents for said pigments, auxiliary agents and water.

A paper coating dye, according to the present state of the art, contains generally the following substances:

- 20 – 70%, particularly 30 – 60%, preferably 40 – 50% white pigments (one or several);
- 5 – 35%, preferably 15 – 25% binding agent (one or several), preferably in 40 – 60% aqueous dispersion;
- 0 – 3%, preferably 0.1 – 1.5% optical brightening agents;
- 0.1 – 10%, preferably 0.1 – 5% retention agent;
- 0 – 1% preferably 0.1 – 0.4% dispersing agent;
- 0 – 1% , preferably 0.05 – 0.5% alkali, preferably soda lye or ammonia.

The remainder water.

Such a paper coating dye thus constitutes a relatively complicated multi-substance system in which the technical applications and rheological, physical and chemical properties may be varied over a broad range by changing the formula as well as by election of the individual components.

As white pigments the following substances are customarily used: kaolins (aluminum silicates), calcium carbonate, satin white (calcium aluminum sulfate), titanium dioxide, and Blancfix (precipitated barium sulfate). Colored coating compounds are also known.

The use of kaolins requires, in most cases, the co-use of dispersing agents. Such dispersing agents comprise certain polyphosphates.

It is the function of the binding agent to bind on the paper after the first drying, the pigment contained in the coating dye. The aim is to bind the single pigment particles to each other sufficiently firmly so that a coherent, smooth film of sufficient inherent strength is obtained to prevent the paper from tearing lengthwise during printing. The known binding agents consisting of natural substances, preferably casein, possess relatively poor binding strength, practically no resistance to water, but have a very good dispersing effect and also have excellent water retention capability.

Owing to the high viscosity of casein, it can be used only in paper coating dyes with up to about 40% content of solids if it is used as the only binding agent. The wet strength is normally enhanced by hardening the casein with satin white, formaldehyde, glyoxal or similar products.

Papers coated with casein enjoy a very good reputation as print carriers. All other binding agents based on natural products, however, are practically of no significance.

However, the worldwide shortage of animal protein for human consumption does not justify the consumption of casein in such large amounts for technical purposes. One has thus attempted the developments of synthetic binding agents, particularly dispersions of copolymers of ethylenically unsaturated monomers which are to serve as such binders. These so-called latices, as dispersions of plastic materials in water, also result during drying by condensation in a binding film the properties of which may be controlled, depending on the composition of the polymer forming the base.

The binder dispersions are, in most cases, prepared by so-called emulsion polymerization in aqueous phase. These dispersions are very fine size dispersions comprising particles within the range of 0.05 and 2 micron, concentrations of plastic material of from 40 – 55%, and a molecule structure which preferably consists of monomers such as butadiene, styrene and acrylic acid derivatives.

These synthetic binding agents are advantageous not only because their use does not further strain the food supply conditions in the world; their low viscosity, uncomplicated application without any special decomposition and dissolving methods needed, high water strength and favorable rheologic properties, which may be controlled, are advantageous characteristics. Contrary to the natural product casein, synthetic binding agents may be prepared with a quality that is always reproducible.

However, one serious drawback of latex binders is their lack of water retention capability. While casein is applied as a solution, the latices are applied in dispersed form which is known to prevent any binding of the water. However, the water retention capability of a paper coating dye constitutes a substantial criterion for its usability because the penetration of the water through the paper must take place in a timewise defined manner and not with such uncontrolled rapidity that would remove excessive amounts or water from the coating dye prior to its reaching the blade, so that the dye can no longer be smoothened.

For the above reason it has already been attempted to add water retention agents to coating dyes in which the casein proportion was entirely or partially replaced by synthetic binder. These water retention agents possess water-retention capability, but they do not act as a binder. Therefore, high molecular substances such as CMC, polyvinyl alcohol and sodium alginate may be added in amounts of from 0.1 to 2.5% to the coating dyes, which substances produce the missing water retention capability of the dye. However, amongst these polymers, polyvinyl alcohol is only poorly suitable because of its dilating behavior under high shearing stresses, i.e., the high shearing stresses occurring in front of the coating blade which lead to an increase of the viscosity in the coating dye and thus result in a poorer uniformity of the coating. Carboxymethyl cellulose has only little water retention capability; only sodium alginate was found to be a retention agent having very high retention capability.

Moreover, papers coated with alginate show good printability. However, owing to the fact that alginates find use in the field of foodstuff preparation, and they may be recovered only in certain oceanic areas, there is an increasing alginate shortage, which makes them expensive auxiliary agents. Also, it appears questionable whether the industrial demand for alginates can be met on a long-term basis.

The creation of new retention agents that would permit the achievement of results comparable to paper coating dyes containing alginates would thus be a novel, additional way that constitutes a technical progress.

The trend in the field of machinery points to the preferred use of so-called blade coaters equipped with either a so-called trailing blade or an inverted blade. These coating machines permit particularly high operating speeds of from 700 to 1200 m/min., however, they require coating dyes that are relatively rich in substance, namely with a solids content of from 50 to 65%. Such high solids content can be achieved only and exclusively by the use of synthetic binding agents.

The extremely high shearing stresses acting in connection with such high-speed coating machines on the coating dye within the proximity of the blade makes the use of dilating additions such as, for example, polyvinyl alcohol, very questionable. Water retention agents according to the present invention, on the other hand, show a structurally viscous (pseudoplastic) flow behavior and were found to be excellently usable even at machine speeds of 1000 meters/min. and more.

It is an object of the present invention to provide novel paper coating dyes which do not possess the aforesaid shortcomings, and which may be prepared in a technically progressive manner.

The solution to the problem of the present invention comprises paper coating dyes having the customary composition with the distinction that casein is totally or partially replaced by synthetic binding agents, and which also contain a water-retention agent, said paper coating dyes being characterized by the fact that they contain, as the water retention agent, carboxymethyl ether of top grade flours (firsts). Such top grades of flour are, for example, the galactomannans, carobbean and guarane, and also the poysaccharide from Tamarindus indica which is composed of galactose, xylose and glucose.

The carboxymethylated firsts are added to the coating dyes advantageously in concentrations of from 0.1 to 5%, and produce, on the one hand, an excellent water retention capability and additionally quarantee, on the other hand, good printability of the paper finished with such coating dyes. The polysaccharide ethers are recovered from the above-stated natural polysaccharides by known methods. The preparation of such products in suspension is possible, for example, according to German Pat. No. 896,795. The molar ratio of the etherifying agent to saccharide unit should advantageously be 0.3 up to 1.3.

The naturally found polysaccharides of carobbean, guarane and Tamarindus indica in aqueous solution produce viscosities which are much too high for application according to the present invention. The polysaccharide must therefore be adjusted to a substantially lower viscosity either before or after the etherifying reaction, and is achieved by employing known methods. Such a reduction of the viscosity is known in principle. It should preferably take place hydrolytically and/or oxidatively, i.e., the intended fragmentation of the polysaccharide chain should take place with either acid, preferably hydrochloric acid, or mild oxidation agents, preferably hydrogen peroxide or hypochlorite.

The carrying out of the method is not affected by whether said hydrolytic and/or oxidative reduction takes place in an aqueous or alcoholic medium or according to the so-called Blattmann method (German laid-open Specification No. 1,443,488) as a gas phase hydrolysis with gaseous HCl. The aforementioned reactions for such a reduction are employed worldwide for the preparation of, for example, auxiliary textile agents.

For the purpose of achieving optimal viscosity, the polysaccharide is thus subjected, either before or subsequent to the etherifying reaction, to a hydrolytic and/or oxidative treatment which yields a viscosity of from 250 to 4000 cP in 4% aqueous solution of the final product, measured at 20° C with the viscosimeter according to Brookfield. Such products may be processed, on the one hand, without any difficulty for producing paper coating dyes that are rich in substance, and they insure good water retention, on the other hand. The products according to the present invention are readily soluble in cold water and show only slightly natural color. Their rheologic behavior shows no dilatency, the products are rather structurally viscous, i.e., their viscosity decreases reversibly with any increase in shearing loads.

It is a particular advantage of the top grade flour products according to the present invention that the rheologic properties of the polysaccharide ethers may be controlled by varying the length of the chain, the degree of substitution and the initial polysaccharide. Carboxymethyl ethers from carob, for example, show a rheologic behavior that is closer to Newton's flow than the flow pattern of the respective guarane ethers which possess a more pronounced structural viscosity. The rheologic characteristics also may be altered by varying the chain length of the polysaccharides used, with higher molecular products showing a marked structurally viscous flow pattern while lower molecular products show a flow closer to the Newton's pattern.

The thixotropic properties of the carboxymethyl polysaccharides according to the present invention are only little pronounced as had to be expected. Surprisingly, however, it was found that the thixotropic behavior of coating dyes is also diminished by adding the polysaccharide ethers according to the present invention, namely more so than when adding alginates having the same viscosity.

The polysaccharide ethers according to the present invention can fixate added optical brightening agents and thus promote their effect.

The present invention is explained in greater detail with the help of the following examples. The parts indicated in said examples are by weight.

EXAMPLE 1

45 parts guarana flour were suspended in
90 parts methanol and
2.25 parts hydrochloric acid were added. Agitation took place for 160 minutes at 50° C, and subsequently there were added
9 parts caustic soda and
30 parts sodium monochloric acetate. The etherification reaction was carried out for 10 hours at 50° C.
2.5 parts hydrochloric acid were added, and subsequently filtration and drying were carried out. The resulting substance was a slightly yellowish powder which, in 4% aqueous solution, had a viscosity of 1250 cP (at 20° C, viscosimeter according to Brookfield). The substance was found suitable as an additive to paper coating dyes.

EXAMPLE 2

90 parts carobbean flour were suspended in
210 parts methanol and degraded for 50 minutes at 55° C by adding
7.5 parts hydrochloric acid and
1 part hydrogen peroxide. Upon addition of
30 parts caustic soda and
75 parts sodium monochloric acetate, agitation was carried out for a duration of 8 hours at 50° C. Subsequently, 8 parts hydrochloric acid were added, and the mixture was cooled, filtered and dried.

The resulting product had in 4% solution a viscosity of 1970 CP (20° C, Brookfield) and was found to be excellently suitable as an additive for coating compounds.

EXAMPLE 3

41 grams caustic soda were added to
700 ml methanol (92%) and dissolved therein under agitation.
162 grams tamarind seed flour were suspended in the solution and
116 grams sodium monochloric acetate were added subsequently. Boiling was carried out for a duration of 2 hours under agitation and reflux, then cooling to 20° C. Subsequently,
10 ml hydrogen peroxide (30% concentration) were added, the mixture was heated again and agitated for 30 minutes under ,eflux. The preparation was cooled, neutralized with concentrated hydrochloric acid, filtered, and the filter cake dried. The resulting powder dissolved in cold water.

The 4% solution had a viscosity of 790 cP (20° C, Brookfield). The product is suitable as a retention agent for paper coating dyes.

EXAMPLE 4

A paper coating dye was prepared according to the following formula:

90 parts kaolin (China clay SPS, extra white, powder)
10 parts calcium carbonate (precipitated)
0.2 parts polyphosphate
0.1 part soda lye, 50%
70 parts water
36 parts dispersion binder, 50% (binder CA 7568, Bayer)
0.3 parts retention agent
(a) sodium alginate
(b) guara ether according to Example 1
(c) carobbean ether according to Example 2
(d) seed flour ether according to Example 3
(e) without retention agent.

60 grams paper were coated with these four coating dyes, and the matting time was determined visually. Within the frame of the measuring exactness no difference was determined with dyes (a), (c) and (d); the matting time for coating dye (b) was about 10% longer, and 30% shorter with coating dye (e).

The coating compound according to Example 4 was rheologically compared as follows:

(a) with sodium alginate
(c) with carobbean seed ether, and
(e) without retention agent.

The test indicated that the thixotropic properties of a paper coating dye are clearly reduced by the addition of retention agents. The effect of the carboxymethyl carobbean surpasses even the one of alginate.

EXAMPLE 5

The product according to Example 1 was measured by means of the rotation viscosimeter (Rotovisko by Haake) working according to the Searle principle. The following values were established in 5% aqueous solution:

| FIRST RUN | | Shear | RETURN RUN (REFLUX) | |
|---|---|---|---|---|
| Shearing Stress (dym/cm²) | Viscosity (cP) | Gradient (sec⁻¹) | Shearing Stress (dym/cm²) | Viscosity (cP) |
| 236 | 179 | 162 | 220 | 167 |
| 367 | 139 | 263 | 377 | 143 |
| 498 | 126 | 394 | 488 | 124 |
| 682 | 86 | 789 | 603 | 76 |
| 865 | 73 | 1183 | 776 | 66 |
| 1049 | 44 | 2366 | 1091 | 46 |
| 1196 | 34 | 3550 | 1442 | 41 |
| 2176 | 31 | 7100 | 2203 | 31 |
| 2727 | 26 | 10620 | 2727 | 26 |
| 3697 | 17 | 21300 | 3697 | 17 |

The measured values indicate that within the frame of the measuring exactness no time-dependent viscosity effects (thixotropy,rheopexy) were determined.

We claim

1. A paper coating dye composition of the type containing white pigments, binding agents for said pigments and a water retention agent, comprising 0.1 - 5% of a carboxymethyl ether of seed flour as the water retention agent, said carboxymethyl ether being subjected to oxidative, or hydrolytic and oxidative treatment prior to, or subsequent to the etherification, and which has a viscosity of 250 - 4,000 cP measured at 20° C on a Brookfield viscosimeter in a concentration of 4% in cold water.

2. Paper coating dyes according to claim 1, wherein the water retention agent is a carboxymethyl ether of carob, guarana or of the polysaccharide obtained from tamarindus indica.

* * * * *